United States Patent [19]

Kishido et al.

[11] Patent Number: 4,561,378

[45] Date of Patent: Dec. 31, 1985

[54] COATING APPARATUS

[75] Inventors: Takeshi Kishido; Tetsuya Yoshino, both of Hachioji; Takashi Kageyama, Hino; Kazuo Kato, Hachioji, all of Japan

[73] Assignee: Konishiroku Photo Industry Co., Ltd., Tokyo, Japan

[21] Appl. No.: 505,708

[22] Filed: Jun. 20, 1983

[30] Foreign Application Priority Data

Jun. 22, 1982 [JP] Japan ..... 57-106136

[51] Int. Cl.[4] ..... B05C 5/02; B05C 13/00

[52] U.S. Cl. ..... 118/62; 118/407

[58] Field of Search ..... 118/62, 407, 412, 411, 118/459

[56] References Cited

U.S. PATENT DOCUMENTS 3,589,331 6/1971 Westervelt et al. ..... 118/62

4,178,397 12/1979 Lovis ..... 118/62 X

FOREIGN PATENT DOCUMENTS 2812351 9/1978 Fed. Rep. of Germany ..... 118/62

*Primary Examiner*—John P. McIntosh

*Attorney, Agent, or Firm*—James E. Nilles

[57] ABSTRACT

A coating apparatus wherein the coating is made by a coater while a support is carried in a non-contacting manner by a gas jetted from a gas jetting device towards the support. The gas jetting device has a hollow housing into which the gas is introduced from a gas source, the wall of the housing adjacent to the support being provided with a plurality of gas jetting nozzle ports through which the gas is jetted towards the support, each gas jetting nozzle port having a throat portion presenting a minimum cross-sectional area inwardly spaced from the outer surface of the wall of the housing and an enlarged outlet portion presenting a comparatively large diameter and opening in surface of the wall. The ratio of port area is adjusted in such a manner that the rate of jetting of the gas from unit area of the outer surface of the gas jetting device becomes smaller as the width of the support is increased.

5 Claims, 9 Drawing Figures

COATING APPARATUS

BACKGROUND OF THE INVENTION

1. Field of the Invention

The present invention relates to a coating apparatus for applying a liquid to the surfaces of a flexible support sheet (referred to simply as "support", hereinunder) while carrying the support without contacting the same. More particularly, the invention is concerned with a coating apparatus for coating one or two kinds of liquid on a support such as a photosensitive photographic material while carrying the support at its surface opposite to the coated surface and allowing the same to run continuously. Still more particularly, the invention is concerned with a coating apparatus suited to continuous coating of both sides of the support.

2. Description of the Prior Art

In the conventional process for producing photosensitive photographic materials coated at both sides of a support, the support is subjected twice to the same steps, i.e. the application of the liquid, gelation of the liquid and drying, such that the application of the liquid to the second side is started after the drying of the coating film on the first side. In recent years, however, various methods have been proposed to form coating layers on both sides of the support by making the latter to pass the steps of application and drying only once, in order to attain a higher productivity. These methods are grouped into several types in one of which the application of the liquid to the second side is made after gelation of the coating film on the first side. Two methods of this type have been proposed up to now: namely, (i) a first method in which, after gelation of the film on the first side of the support, the liquid is applied to the second side while the support is carried at its first side by supporting rolls in direct contact with the latter as disclosed in Japanese Patent Publication No. 44171/1973 and (ii) a second method in which, as disclosed in Japanese Patent Publication Nos. 17853/1974 and 38737/1976, the support is suspended at its first side having the coating layer by a gas jetted from the surface of a supporting roll having a predetermined curvature during the application of the liquid to the second side of the support. The first method (i) suffers from various problems as follows. Namely, a strict management of the coating system is required to eliminate scratching or dust in or on the roll surface because the coating is made defective even by a slight scratch or dust in or on the supporting roll surface. Even when there is no scratch or dust, the coating layer is disturbed when a portion of the support having a fluctuation of the coating film thickness, e.g. the portion where the application is started, spliced portions and so forth passes the supporting roll in contact with the latter. In such a case, a part of the gelated liquid may attach to the supporting roll surface to disturb the coating layer on the following portion of the support. In the method (ii) mentioned before, unevenness of the coating film thickness in the form of step lines transverse to the longitudinal direction of the support tends to be caused by a slight fluctuation of the lift of the support above the supporting roll attributable to, for example, a change or fluctuation in the tension acting on the support. In the method shown in Japanese Patent Publication No. 17853/1974 in which the end of a coater is pressed to the surface of the support while the latter is made to float above the supporting roll surface by the gas jetted from the roll having small apertures or slits, the above-mentioned tendency is appreciable particularly at the end portions of the support. In contrast, in the method shown in Japanese Patent Publication No. 38737/1976 which employs such a roll as to adapted to carry the support at both marginal edges to keep the support substantially afloat, the above-mentioned tendency is heavy particularly in the central portion of the support.

The method disclosed in Japanese Patent Publication No. 17853/1974 in which the coating is made on both sides of the support by the method (ii) mentioned before, a defect generally referred to as "unevenness due to blowing", i.e. a fluctuation in the coating film thickness tends to be caused in the first side because of dynamic pressure of the gas impinging upon the first side for carrying the support during the application of the liquid to the second side.

On the other hand, the method disclosed in Japanese Patent Publication No. 17853/1974 involves a problem that, since the variation of the lift in the widthwise direction becomes large as the width of the support gets large, it is difficult to press the end of the coater uniformly to the support and, hence, to obtain a uniform thickness of the coating layer on the entire surface of the support. In addition, the coating film thickness is apt to be varied because no specific consideration is given to the prevention of the vibration of the support at the front and rear sides of the coater. Furthermore, it is not possible to apply the bead application method employing, for example, a slide hopper which is commonly used in the application of photosensitive photographic material, because of the direct pressing of the coater to the support.

Referring again to the method disclosed in Japanese Patent Publication No. 38737/1976, the distance between the support surface and the end of the coater at both marginal ends of the support where the latter is carried by the supporting roll is not equal to that at the other portions of the support out of contact with the supporting roll. This makes it difficult to obtain a uniform thickness of the coating layer. More practically, a coating defect in the form of longitudinal stripes tends to appear. The difference of the aforementioned distance becomes larger as the width of the support becomes greater. In the worst case, some portions of the support may not be coated by the liquid at all.

In the method disclosed in Japanese Patent Laid-Open No. 45410/1980, the position of the support at portions thereof other than both marginal ends carried by the supporting roll is determined by a delicate balance between the back pressure (T/R, T: tensile strength, R: radius of curvature of support surface) produced by the tension and the reduced pressure applied by the coater. Thus, the position of the support is changed even by a slight unbalance between these forces to cause a change in the distance between the end of the coater and the support, resulting in an uneven thickness of the coating film in the form of step lines transverse to the longitude of the support. It is quite difficult to maintain the reduced pressure applied by the coater, over the entire width of the support. In consequence, the coating defects such as unevenness of coating thickness in the form of step lines transverse to the longitudinal direction, longitudinal stripes and liquid application failure are liable to occur.

The present inventors have made an intense study to overcome the problems of the prior art heretofore described and have reached the following conclusion.

From a generic point of view, in the known methods or apparatus in which the support is carried by the gas, i.e. carried by supporting roll without contacting the same, only a fundamental construction is offered or an effort is concentrated mainly to effect the elimination of the vibration of the support in the thicknesswise direction of the latter. Namely, no specific consideration is given to the uniformalization of the gap between the coater end and the support surface (this gap will be referred to as "coater gap", hereinunder) along the width direction of the support. This is quite vital in the bead application method which employs a slide hopper or the like, because the lack of uniformity of the coater gap along the width direction is liable to cause the unevenness of the coating layer thickness in the form of longitudinal stripes. In the worst case, some portion of the support is not at all contacted by the liquid. Usually, the end of the coater and the outer surface of the gas jetting device are constructed as linearly as possible along the width direction of the support. Therefore, the coater gap will be uniformalized along the width direction of the support within the tolerance of the machining, provided that the lift of the support from the surface of the gas jetting device is uniform along the width direction of the support. As a matter of fact, however, the lift of the support is fluctuated largely along the width direction of the support because no positive measure has been taken for uniformalizing the lift. Therefore, it has been quite difficult to obtain a practical application device which can uniformly apply the liquid. The uniform lift of the support along the width direction becomes more difficult as the width of the support gets larger, and this problem becomes more serious as the width of the support is increased beyond about 500 mm. Considering that the support width usually exceeds 500 mm in most coating apparatus designed for attaining a high productivity, it is almost impossible to avert from the above-described problem in developing a non-contact carrying type coating apparatus for coating both sides of the support. Throughout the specification, the term "wide support" is used to mean support having a width exceeding 500 mm, while the term "narrow support" means support of width less than 500 mm.

SUMMARY OF THE INVENTION

Accordingly, an object of the invention is to provide a coating apparatus for coating both sides of a support, wherein the support is carried without being contacted mechanically but by the jet of a gas from a gas jetting device while eliminating any fluctuation of the floating distance so that the liquid is applied to the side of the support opposite to the gas jetting device without any unevenness of thickness in the form of transverse stripes while avoiding any unevenness of thickness due to blowing on the first coated side upon which the gas jet impinges, so that coating layers of uniform thickness are formed on both sides of the support thereby to overcome the above-described problems of the prior art.

To this end, according to the invention, there is provided a coating apparatus having a coater and a gas jetting device disposed to oppose to each other across a continuously running support, in that the coating is made by the coater while the support is carried in a non-contacting manner by a gas jetted from the gas jetting device towards the support, and the gas jetting device has a hollow housing into which the gas is introduced from a source, the wall of the housing adjacent to the support being provided with a plurality of gas jetting nozzle ports through which the gas is jetted towards the support, each gas jetting nozzle port having a throat portion presenting a minimum cross-sectional area inwardly spaced from the outer surface of the wall of the housing and an enlarged outlet portion presenting a comparatively large diameter and opening in the surface of the wall, the minimum diameter presented by the throat portion ranging between 0.02 and 0.5 mm and the maximum diameter presented by the enlarged outlet portion ranging between 0.5 and 5 mm.

By selecting the diameters to fall within the ranges specified above, it is possible to largely suppress the fluctuation of the floating distance (referred to as "lift") of the support so that coating layers of highly uniform thickness are formed stably on both sides of the support.

According to a preferred form of the invention, the throat portion and the enlarged outlet portion are formed by boring a through hole of the same diameter as the enlarged outlet portion in the wall of the gas jetting device, and embedding and fixing a pierce tube in the through hole, the pierce tube having a configuration to substantially close the through hole and having an inside diameter substantially equal to that of the throat portion.

The present inventors have made various studies on the coating methods and apparatus of non-contact carrying type such as those listed in (i) and (ii) before, and have reached the following conclusion. Namely, the essence of the non-contact type carrying technic is to form, between the support and the outer surface of the gas jetting device, a space of a static pressure higher than the ambient pressure, i.e. the pressure on the side of the support to which coating is made by the coater, by jetting the gas from the gas jetting device so as to keep the support afloat above the gas jetting device, thereby to carry the support by the high static pressure without permitting the support to contact the surface of the gas jetting device. The region where the high static pressure for carrying the support is established will be referred to as "non-contact carrying region" hereinunder. The non-contact carrying method in the apparatus of the invention is based upon substantially the same principle. When a tensed support is carried while being curved or bent by a force applied thereto in the direction perpendicular to the tensile strength, a pressure expressed by T/R (T: tension applied to the support, R: radius of curvature of curved portion) is produced in the bent portion of the support to act in the direction opposite to the force for carrying the support. This pressure will be referred to as "back pressure", hereinunder. Thus, the static pressure in the non-contact carrying region, i.e. the static pressure for carrying the support, has to be balanced by the back pressure. In other words, the support is moved to and held a position where the back pressure and the carrying static pressure balance each other. More specifically, the space of the high static pressure is continuously supplied with the gas jetted from the gas jetting device. The outgoing flow of the gas from this space, however, is made to pass a restricted gap between the support and the gas jetting device and, accordingly, encounters a resistance determined by the size of the gap, i.e. the lift of the support, so that the high static pressure determined by the factors including the rate of incoming flow of gas and the above-mentioned flow resistance is established and maintained in the above-mentioned space. A discussion will be made hereinunder as to how the rate of jetting of the gas, carrying static pressure which equals to the back pressure and the lift of the support are related to one another. Under a condition where the back pressure is maintained constant, the lift is increased as the rate of jetting of the gas becomes large. If the rate of jetting of the gas also is constant, the lift of the support is maintained at a constant value matching for the flow resistance of the gas. In the event that the lift of the support is increased for any reason while the other factors are unchanged, the flow resistance in the aforementioned gap is decreased to lower the carrying static pressure. The increase of the lift on the other hand increases the value of R in the ratio T/R to reduce the back pressure. The rate of reduction of the back pressure, however, is much smaller than the rate of reduction of the carrying static pressure to cause an apparent increase of the back pressure to urge the support towards the gas jetting device. In consequence, the lift is decreased followed by an increase in the flow resistance, so that the support is settled at a lift where the carrying static pressure balancing the back pressure is maintained, i.e. at the same lift as that obtained before the increase of the lift. This process for the determination of the lift is performed equally also when the back pressure is changed first. Namely, the lift is changed to attain the balance between the back pressure and the carrying static pressure and always takes the value corresponding to the rate of jetting of the gas. The unevenness of the coating layer thickness in the form of transverse step lines experienced in the coating method and apparatus mentioned in (ii) before is attributable to the fluctuation of the lift as stated above. It proved that the amplitude of the fluctuation of the lift is as large as several tens of microns. This phenomenon will be explained in more detail. The fundamental cause of the lift fluctuation is a fluctuation in the tension applied to the support, which in turn causes not only a change in the ratio T/R, i.e. the back pressure but also a fluctuation in the rate of jetting of the gas, resulting in an amplified fluctuation of the lift. In the jetting of the gas, the gas is driven by the force proportional to the difference between the source pressure and the carrying static pressure. When the lift is changed by a change in the back pressure, the carrying static pressure is changed also to balance the back pressure. Assuming that the back pressure is, for instance, increased, the lift is decreased while the carrying static pressure is increased. In consequence, if the gas source pressure is constant, the rate of jetting of the gas is decreased because the differential pressure is reduced, so that the decrease in the lift is amplified. In other words, if the rate of jetting of the gas is maintained constant, the fluctuation in the lift is minimized even if the tension in the support is changed by disturbance. In this case, the generation of unevenness in the form of transverse step lines is avoided advantageously.

In a process for preparing photosensitive photographic material to which the invention pertains, wherein the support is coated at its first side and, after the gelation without subsequent drying, the support is carried at its gelated first side by a gas in the non-contacting manner to permit the application of the liquid to the second side, there is a fear that the gelated layer on the first side may be disturbed by the gas jetted from the gas jetting device and impinging upon the gelated layer, i.e. a fear to suffer the unevenness due to blowing. The unevenness of the thickness due to blowing takes place when the momentum of the jetted gas exceeds the strength, i.e. the surface tension, of the coating layer in the area at which the gas impinges upon the coating layer. Therefore, two countermeasures are conceivable for preventing the unevenness due to blowing: namely to increase the strength of the coating layer and to decrease the momentum of the jetted gas. It is preferred to increase the strength of the coating layer as much as possible. The strength however, varies depending on the kind of the coating liquid, and cannot be increased in an uncontrolled manner because of restriction from various factors such as condition of preparing and so forth, as well as the required performance particularly when the material to be prepared is a photosensitive photographic material. The technical subject to be achieved, therefore, is focused to the latter way, i.e. to decrease the momentum of the jetted gas. As stated before, in order to maintain a predetermined lift of the support under the application of a constant tension, it is necessary to keep a constant rate of jetting of the gas from the gas jetting device. Therefore, it is necessary to amplify the area of the coating layer directly collided by the jetted gas, thereby to maintain sufficiently small the rate of gas impinging upon unit area of the coating layer. One of the measures for attaining such amplification of area is to increase the speed of transfer of the support. This, however, cannot satisfy the aforementioned demand satisfactorily because of various reasons such as fear for generation of unevenness in the form of longitudinal stripes and winding of the support over the entire transfer line, as well as an increased drying load.

From these points of view, it is considered that the best way to meet all requirements is to construct the gas jetting ports in such a manner as to permit the dispersion of the gas jetted at a constant rate from the jetting device over an area as wide as possible.

The present inventors have accomplished the coating apparatus of the invention on the basis of these knowledges and finding out. Namely, the present inventors have succeeded in developing a coating apparatus which is freed from the problems such as unevenness of thickness in the form of transverse step lines as well as the unevenness of thickness due to blowing on the side of the support upon which the jetted gas impinges, by arranging such that, while the gas is jetted at a constant rate from the surface of the gas jetting device, the stream line of the gas jetted from each gas jetting port drastically diverges to impinge upon the coated surface of the support over an area as wide as possible.

Another object of the invention is to provide a coating apparatus for forming coating layer or layers of highly uniform thickness on a web-like flexible support such as a photosensitive photographic material, wherein the application of the coating liquid to the support is made while carrying the support in non-contacting manner and maintaining a constant coater gap along the width direction of the support.

Still another object of the invention is to provide a coating apparatus for coating both sides of a support, wherein the support is required to pass through a drying section only once to permit a high production efficiency of the coating process in an industrial scale.

To these ends, the invention provides a coating apparatus as mentioned before further comprising means for adjusting the ratio of port area in such a manner that the rate of jetting of the gas from unit area of the outer surface of the gas jetting device becomes smaller as the width of the support is increased.

According to another form of the invention, the ratio of port area in the gas jetting device for carrying wide support is adjusted to meet the condition of $W^2 \cdot Q \leqq 5 \times 10^5$. The term of ratio of port area in this case is not a local value but is a mean value over the entire part of the non-contact carrying region. In addition, the non-contact carrying region is the region except the boundary 13 between the area in which the support is affected by the gas jetted from the jetting device and the area in which the support is not affected by the gas, as well as the widthwise marginal end portions where the ratio of port area is greater than in other areas. As seen from FIG. 1, in the boundary 13, the gas jetted from the jetting device is directly relieved to the outside to decrease the lift of the support. The boundary 13, therefore, is independent from the means for adjusting the ratio of port area in accordance with the support width for jetting the gas at a large rate to prevent the contact of the support.

These and other objects, features and advantages of the invention will become clear from the following description of the preferred embodiments taken in conjunction with the accompanying drawings.

DESCRIPTION OF THE PREFERRED EMBODIMENTS

Figure 1:
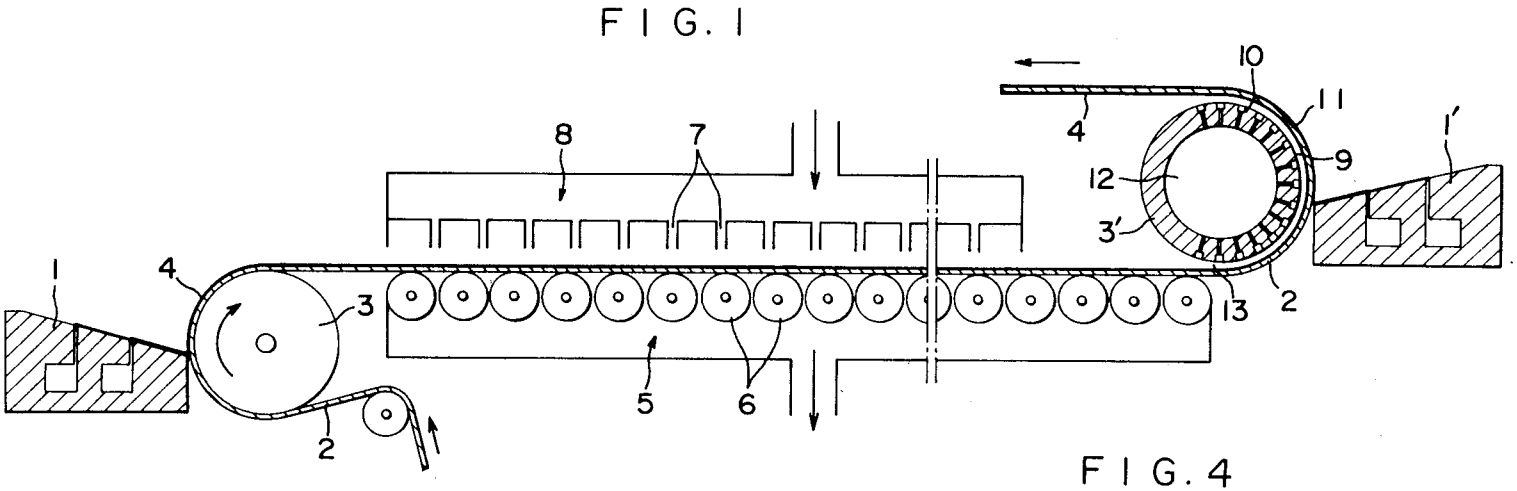
FIG. 1 is a vertical sectional view of an embodiment of the coating apparatus in accordance with the invention, wherein a double-layer coating system employing a slide hopper is adopted to coat both sides of the support consecutively.
Figure 4:
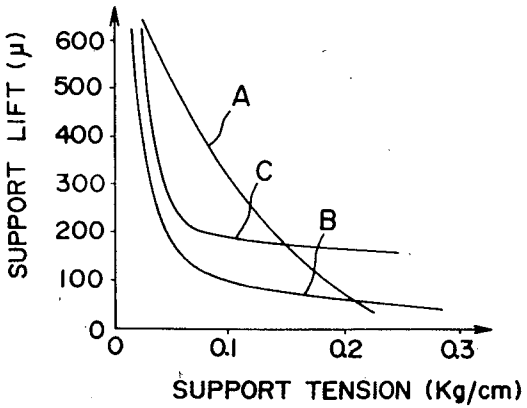
FIG. 4 is a graph showing the relationship between the tension in the support and the lift of the support at the portion thereof confronting the end of a coater in the non-contact carrying region, wherein curves A and B show characteristics observed in the conventional coating apparatus while a curve C shows the characteristics as obtained with the coating apparatus of the invention.
Figure 3:
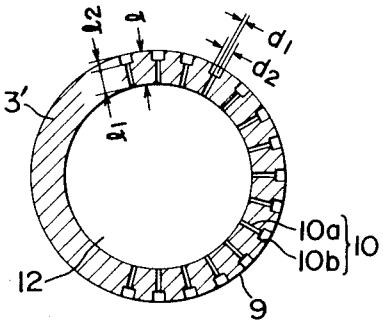
FIGS. 2 and 3 are sectional views of a gas jetting device incorporated in the conventional coating apparatus and a gas jetting device incorporated in the coating apparatus of the invention.
Figure 2:
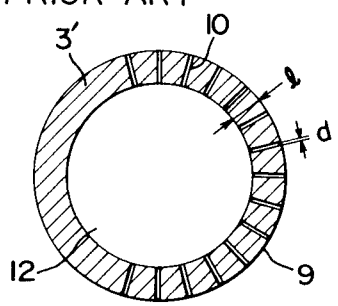
FIG. 2 PRIOR ART

FIG. 1 shows an embodiment of the coating apparatus of the invention, adopting a double-layer coating system employing a slide hopper, for consecutively applying a photosensitive photographic solution on both sides of a support. FIGS. 2 and 3 show, respectively, an example of the gas jetting device incorporated in a conventional coating apparatus and a gas jetting device incorporated in the coating apparatus of the invention. FIG. 4 is a graph showing the relationship between the tension in the support and the lift of the support at the portion confronting the end of the coater in the non-contact carrying region, wherein curves A and B show the characteristics as observed in the conventional apparatus, while curve C shows the characteristics as obtained with the coating apparatus of the invention.

Referring to FIG. 1, the support 2 is coated with a liquid by a known process employing a coater 1 while being carried by a supporting roll 3 in direct contact with the latter. For the gelation of the coating layer 4, the support 2 is then made to pass through a cold air zone 8 in which cold air is applied to the coating layer 4 through a slitted plate or a group of apertures 7. In order to increase the cooling efficiency and to promote the gelation, it is preferred to mount a group of rolls 6 on a central box 5 at the non-coated side of the support 2, preserving a gap of 2 to 3 mm between the rolls 6, and a suction force is applied to increase the area of contact between the support 2 and the rolls 6. Then, the support 2 having the coating layer 4 on its one side is made to pass through the non-contact carrying region of a gas jetting device 3' of the coating apparatus of the invention, where the liquid is applied by a coater 1' onto the opposite side of the support 2 to the coating layer 4 to form a coating layer 11. Although various types of gas jetting device 3' is available, the illustrated embodiment employs, by way of example, a hollow roll type device which is considered as being most popular from the view point of strength and easiness of fabrication.

In the non-contact carrying region, a gas is jetted through a plurality of gas jetting nozzle ports 10 formed in the surface 9 of the gas jetting device against the support surface carrying the coating layer 4 so as to suspend and carry the support without allowing the latter to be carried by a direct contact with solid part of the apparatus. In the case of the preparation of photosensitive photographic material, it is strictly required to maintain the fluctuation of the thickness of the coating layer in the wet or dried state within 1%. To this end, it is necessary to maintain a constant size of gap between the end of the coater 1' and the surface of the support 2 be coated as much as possible. As a result of various studies, it proved that the width or amplitude of fluctuation of the gap size is preferably within several microns and should not exceed 10 microns at the greatest.

As stated before, the gas jetted from the gas jetting nozzle ports 10, directly impinging upon the gelated layer 4, may cause an unevenness due to blowing.

It proved that, in order to stably coat both sides of the support while avoiding the undesirable unevenness of thickness due to blowing, it is necessary not only to enhance the strength of the gelation of the coating layer 4 but also to construct the gas jetting device 3' such that the gas after leaving each nozzle port 10 diverge and spread to a greater area as possible.

Referring now to FIG. 3 showing in section the gas jetting device 3' incorporated in the coating apparatus of the invention, each nozzle port 10 of the gas jetting device 3' has a throat portion **10*a* where the diameter of the port takes the minimum diameter $d_1$ of 0.02 to 0.5 mm and an enlarged outlet portion 10*b*** of a diameter $d_2$ of 0.5 to 5 mm. With this nozzle arrangement, it is possible to carry the support within the aforementioned allowable range of fluctuation of lift of the support, thereby to permit highly uniform and stable coating on both sides of the support without suffering from unevenness of thickness due to blowing at the first coated side, for the reasons which will be explained hereinunder.

The fluctuation of the lift of the support 2 in the non-contact carrying region is attributable to a fluctuation of the tension in the support, caused by a vibration or oscillation of the support. Namely, vibration or oscillation of the support 2 takes place in the direction perpendicular to the running direction thereof, because the support 2 after leaving the gas jetting device 3' carries undried layers on both sides thereof and, hence, cannot be supported by direct contact. The fluctuation in the tension is caused also by a fluctuation in the driving power exerted by the driving source itself. As stated before, the variation in the tension in the support 2 directly causes a variation in the back pressure and, hence, a variation in the lift.

In order to investigate how the lift of the support is affected by the change in the tension, the lift, i.e. the distance between the surface of the coating layer 4 and the surface 9 of the gas jetting device at a portion of the non-contact carrying region near the end of the coater 1' was measured while varying the tension applied to the support 2, the result of which is shown in FIG. 4. More specifically, curves A, B and C appearing in FIG. 4 were obtained with different gas jetting devices A, B and C all of which are of the hollow roll type. The gas jetting device A has a construction as shown in FIG. 2 in section. More specifically, the radius of the roll outer surface 9 is 100 mm, and each gas jetting nozzle 10 has a constant diameter d of 2 mm over its entire length l which is 5 mm. The ratio of the port area, which will be defined as follows, is selected to be 1%. The term "ratio of port area" in this specification is used to mean the ratio of the sum of cross-sectional areas of throat portions of all nozzle ports in the plane perpendicular to the gas jetting direction to the whole area of the outer surface of the gas jetting device. The gauge pressure of the gas at which the latter is introduced and supplied to the hollow 12 of the gas jetting device is 0.03 $Kg/cm^2$. This pressure will be referred to as "supply pressure", hereinunder. Assuming here that the tension occurring in the support 2 is 0.1 Kg/cm width, a large fluctuation of the lift of the support 2 reaching several tens of microns is caused by a 10% change in the tension, as will be seen from FIG. 4, so that an unevenness of the coating layer thickness in the form of transverse step lines is caused when the liquid is applied by the coater 1'. The gas jetting device B has a construction similar to that of the device A. In this device, however, the diameter d and the length of the jetting nozzle port 10 is 0.1 mm and 10 mm, respectively, while the ratio of port area is 0.1%. In this case, the coating was conducted at a gas supply pressure of 1 $Kg/cm^2$, while other factors are not changed from those in the experiment conducted with the jetting device A. In this case, the fluctuation of the lift is suppressed to about 10 microns at the greatest, even if there is any fluctuation in the tension, so that the generation of unevenness of thickness in the form of transverse step lines is generally avoided. However, since this value of lift fluctuation scarcely clears the allowable limit, the thickness unevenness in the form of transverse step lines may be formed in the coating layer 11 if the fluctuation in the gas supply pressure or the tension in the support exceeds the normal value. The gas jetting device C is the one which is incorporated in the coating apparatus of the invention. As will be seen from FIG. 3 which is a sectional view, the gas jetting nozzle port 10 in this gas jetting device has a stepped wall, i.e. two portions of different diameters. Namely, each nozzle port 10 has a throat portion **10*a* of an inside diameter $d_1$ of 0.1 mm and a length $l_1$ of 10 mm, and an enlarged outlet portion 10*b* having an inside diameter $d_2$ of 2 mm and a length $l_2$ of 3 mm. Other conditions are same as those in the experiment conducted with the gas jetting device B. It was confirmed that, with this gas jetting device, the fluctuation of the lift of the support 2 can be suppressed to about 8 microns and the thickness unevenness in the form of transverse step lines is completely eliminated. Namely, in order to restrain the fluctuation of the lift of the support 2, it is necessary that the line tangent to the curve in the graph shown in FIG. 4 approaches the horizontal line within the normal range of the tension. This in turn requires the gas jetting device to be constructed so as to avoid any change in the gas jetting rate due to a change in the tension. The gas jetting devices B and C were designed taking this point into account. Namely, these gas jetting devices are so constructed that a pressure sufficiently higher than the static pressure in the non-contact carrying region is maintained within the gas jetting device, so that only a negligibly small change is caused in the pressure differential between the inside of the gas jetting device and the non-contact carrying region even when there is a change in the carrying static pressure, i.e. the back pressure, due to a change in the tension. Since the driving force for jetting the gas is determined by the above-mentioned differential pressure, the rate of the jetting of the gas is substantially unchanged because the change in the differential pressure is negligibly small. In the gas jetting device incorporated in the coating apparatus of the invention, the internal gas pressure of the gas jetting device is maintained sufficiently high as compared with the static pressure in the non-contact carrying region for the following reason. Namely, the minimum cross-sectional area, i.e. the cross-sectional area of the throat portion of each nozzle port 10 through which the interior 12 of the gas jetting device is communicated with the non-contact carrying region is extremely small to impose a considerable resistance to the flow of the gas therethrough. Namely, there is a large pressure drop of the gas across the nozzle ports 10. The difference between the curves B and C is attributed to the following reason. The carrying static pressure is not perfectly uniform over the entire area but has a certain distribution in accordance with the pattern of the flow of the gas. Namely, the static pressure is highest in the areas confronting the outlets of the nozzle ports 10 and the static pressure is drastically decreased as the distance from the outlets is increased. In the gas jetting device C, the jetting nozzle port 10 is made to have an enlarged outlet portion of an increased diameter, intended to enlarge or widen the area in which the maximum static pressure is established. With this arrangement, the present inventors have succeeded in increasing the effective static pressure for carrying the support 2 in the non-contacting manner. In other words, in the gas jetting device C, the change in the back pressure caused by a change in the tension is less liable to be transmitted to the outlet portion of the gas jetting port 10**. Therefore, the fluctuation in the gas jetting rate is further decreased even in comparison with the gas jetting device B and the fluctuation of the float is diminished correspondingly.

Another factor to be taken into account is the absolute value of the lift. Namely, if the lift is too small, there is a fear that the coating layer 4 undesirably contacts the outer surface 9 of the gas jetting device at the splice portion or other portion having large thickness. In such a case, a part of the coating layer may attach to the surface 9 of the gas jetting device to contaminate and disoder the trailing portion of the coating layer 4. The gas jetting device B is not free from this problem. However, in the case of the gas jetting device C, the mutual contact between the coating layer 4 and the surface 9 of the gas jetting device is avoided because the effective static carrying pressure is increased to maintain a sufficiently large lift of the support.

The gas jetting device C is effective also in the elimination of the unevenness of thickness due to blowing. Namely, experiments were conducted with gas jetting devices A, B and C for coating both sides of the support by a method as illustrated in FIG. 1. The undesirable thickness unevenness due to blowing was inevitably found in the coating layer formed with the gas jetting device A. The unevenness of thickness was also found in the coating layer formed with the gas jetting device B, by a too high gas supply pressure, insufficient gelation of the layer in the cold air zone 8 and other reasons. In contrast, the unevenness of thickness due to blowing was not found at all in the coating layer formed with the gas jetting device C. These facts will be reasonably explained by introducing the concept of momentum of the gas on the area of the coating layer directly collided by the gas. This area will be referred to as "gas colliding area", hereinunder. The gas jetted from the gas jetting nozzle port 10 is made to collide with the coating layer 4, while diverging or spreading its flow path partly because there is no means for restricting the flow of the gas after emerging from the nozzle port and partly because the pressure around the nozzle port is sufficiently low. Thus, the momentum brought by the gas per unit area of the gas colliding area gets smaller as the density of the gas is decreased due to divergence of the flow of gas. The divergence of the flow of gas is affected by the following three factors independently.

These three factors are: the diameter of the gas jetting nozzle port 10, the distance between the outlet of the gas jetting port 10 and the surface of the coating layer 4 (referred to as "collision distance", hereinunder) and the linear velocity of the gas jetted from the gas jetting device. The momentum of the gas in each case will be discussed hereinunder taking these factors into account, for clarifying the difference in the mechanism of generation of the unevenness of thickness due to blowing.

In the case of the gas jetting device A, the diameter d of the gas jetting nozzle port 10 is about 10 times as large as the gas collison distance, i.e. the lift of the support. The divergence of the flow path of gas is comparatively small, so that the most part of the gas comes into collision with the gas colliding area which is substantially equal to the cross-sectional area of the outlet of the gas jetting nozzle 10, without being decelerated substantially. In consequence, a large momentum is imparted to this gas colliding area to cause an unevenness of thickness due to blowing. In the case of the gas jetting device B, the diameter d of the gas jetting nozzle port is about 1/20 of that in the device A, and is substantially in a 1:1 relation to the collision distance. Therefore, the flow path of the jetted gas diverges comparatively largely to make the gas collide with the gas colliding area which is considerably greater than the cross-sectional area of the outlet portion of the gas jetting nozzle 10. The effect of divergence of the flow path is dominant because the linear velocity of the gas is substantially equal to that produced by the gas jetting device A, since the number of the gas jetting nozzle ports is greater while the total rate of jetting of the gas is smaller. In consequence, the generation of thickness unevenness due to blowing is suppressed considerably as compared with the case of the gas jetting device A. The nozzle port 10 in the gas jetting device C has the enlarged outlet portion **10*b* which offers the following advantage. Namely, in the nozzle port 10 in the gas jetting device C, the divergence of the flow path of the gas is materially started at the outlet side of the throat portion 10*a*. In this case, the collision distance is not equal to the lift of the support but is the sum of the lift and the length $l_2$ of the enlarged outlet portion 10*b*. In this case, therefore, the collision distance is more than 30 times as large as the diameter of the gas jetting nozzle port 10 which is in this case the diameter $d_1$ of the throat portion 10*a***. Thus, in the gas jetting device C, the divergence of the flow path of the gas is much greater than that in the gas jetting device B. Considering that other factors such as linear velocity of the gas are identical to the case of the gas jetting device B, it is clear that the gas jetting device C is more effective in eliminating the undesirable unevenness of thickness due to blowing.

Throughout various studies conducted with various apparatus including those explained hereinbefore, the present inventors have found out that the objects of the invention can be achieved when the following conditions are met.

The gas jetting device has a hollow casing in the wall of which formed are the gas jetting nozzle ports for jetting out the gas supplied to the hollow of the device. It is necessary that each gas jetting nozzle port has a throat portion of an extremely small cross-sectional area for imposing a large pressure drop of the gas to be jetted, followed by a portion of a drastically increased diameter, i.e. the enlarged outlet portion. The diameters of the throat portion and the enlarged outlet portion optimumly range between 0.02 and 0.5 mm and between 0.5 and 5 mm, respectively. The diameter of the gas jetting nozzle port, in this specification, is the diameter of an imaginary circle having an area equal to the cross-sectional area of the nozzle port taken at a plane perpendicular to the direction of flow of the gas. Namely, it is not essential that the cross-section of the port is actually circular. The determination of the relation between the diameter of the throat portion and the diameter of the enlarged outlet portion is made first with the determination of the diameter of the throat portion. As stated before, the smaller the diameter of the throat portion becomes, the more the fluctuation of the lift of support is suppressed. The smaller diameter of the throat portion, however, reduces the rate of jetting of the gas undesirably. It is, therefore, necessary to increase the number of the gas jetting nozzle ports to attain a total gas jetting rate large enough to ensure the desired lift of the support. As a matter of fact, however, it is not allowed to increase the number of the gas jetting nozzle ports in an uncontrolled manner because a too large number will increase the ratio of the area of the enlarged outlet openings to the whole area of the surface of the gas jetting port to cause the outlet openings of the adjacent ports to lap one another or, even if the lap is avoided, the area of the outer surface of the gas jetting device is decreased to reduce unfavourably the resistance imposed on the gas flowing to the outside through the gap between the gas jetting device and the support. To the contrary, it is not allowed to increase the diameter of the throat portion because such increase necessarily requires an increase in the diameter of the enlarged outlet portion. The lengths of the throat portion and the enlarged outlet portion are also the factors which rule the effect of the gas jetting nozzle port having the throat portion and enlarged outlet portion. Insofar as the aim of the nozzle port is to diversify the flow path of the gas by imposing a large pressure drop in the flow of gas, the lengths of these portions of the nozzle port are preferably long. As a matter of fact, however, it is not necessary to preserve large lengths for these portions of the nozzle port because, although the pressure drop is affected by the length of the nozzle port, the same is affected by the square of the diameter. Rather, a too large length of the enlarged outlet portion will increase the volume of that portion to cause an innegligible effect of compressibility of the gas in this portion, resulting in an increased fluctuation of the lift of the support undesirably. The throat portion need not have large length for the same reason. The length of the throat portion, therefore, is determined in accordance with factors such as easiness of machining. The preferred range is laid also on the length of the enlarged outlet portion as stated above. More specifically, for the diameters specified before, the lengths of the throat portion and the enlarged outlet portion preferably range between 5 and 30 mm and between 1 and 5 mm, respectively. These ranges of the lengths, however, are not exclusive and respective portions of the gas jetting nozzle port can have lengths falling out of these preferred ranges.

An explanation will be made hereinunder as to the typical example of the condition of operation. The gas supply pressure at which the gas is supplied to the gas jetting device 3' is preferably 0.1 to 5 $Kg/cm^2$. A gas supply pressure less than 0.1 $Kg/cm^2$ will not be able to develop necessary pressure difference between the interior of the gas jetting device 3' and the non-contact carrying region, whereas a gas supply pressure in excess of 5 $Kg/cm^2$ requires an extremely small diameter of the throat portion 10*a* of the gas jetting nozzle port 10. This range of the gas supply pressure, however, is only a preferred one and the invention can fairly be carried out with gas supply pressure falling out of the range specified above, as will be easily understood. by those skilled in the art. Any gas having no possibility to cause danger, e.g. $N_2$ gas, freon gas and air can be used as the gas supplied to the gas jetting device, although the air can be most conveniently used. When the air is used as the gas, it is necessary to clean the air by means of an air cleaner before it is supplied to the gas jetting device, for otherwise troubles such as clogging of the nozzle ports may be caused.

It is quite a natural measure to increase the strength of the coating layer 4 itself to suppress the generation of thickness unevenness due to blowing. In the case where the liquid material applied is a photosensitive photographic material, it is necessary to adjust the temperature of the cold air applied through the slitted plate 7 in the cold air zone 8, as well as the suction force in the central box 5, such that the coating layer just entering the non-contact carrying region exhibits a temperature of between 2° and 5° C.

Any material can be used as the material for the gas jetting device 3', if it is strong enough to withstand the internal gas pressure. Examples of preferred materials are stainless steel and brass steel plated with hard chromium. The use of plastic is also preferred from the view point of easiness of formation of the gas jetting nozzle ports 10.

Material for supporting photosensitive material such as plastic films, e.g. polyethylene terephthalate, triacetyl cellulose and so forth, as well as paper, can be used as the flexible support used in the invention.

The present invention offers the following advantages.

(1) The process for manufacturing, for instance, a photographic film, has the steps of applying one or more liquids such as photosensitive liquids to one side of the support, gelating the liquid or liquids and, while carrying the support without permitting the gelated coating layer to be contacted by stationary part, applying a liquid or liquids to the opposite side of the support. According to the coating apparatus of the described embodiment, it is possible to hold the support afloat without causing disturbance of the gelated coating layer while suppressing the fluctuation of the lift of the support and maintaining the desired coater gap accurately by a simple arrangement. It is, therefore, possible to coat both sides of the support with high uniformity of the thicknesses of coating layers.

(2) For the reasons stated above, it is possible to effect the coating on both sides of the support almost simultaneously by only one passage of the support through the coating and drying step. In consequence, the productivity is improved remarkably.

(3) In the case where the coating is to be made only on one side of the support, the undesirable unevenness of the coating, which is inevitable in the conventional apparatus due to the dusts attaching to the contact type supporting roll, is avoided thanks to the use of non-contact type carrying means in place of the contact type supporting roll.

Figure 6:
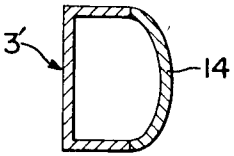
FIG. 6 is a sectional view of another example of the gas jetting device incorporated in the coating apparatus of the invention.

A preferred embodiment of the invention has been described with reference to FIGS. 1 to 4. The invention, however, is not limited to the described embodiment, and the essence of the invention is to use a gas jetting device which has a continuous curved outer surface cooperating with the support in defining therebetween a gap in which a static carrying pressure is established, the gas jetting device having gas jetting nozzle ports each having the throat portion of restricted cross-sectional area and an enlarged outlet portion. Thus, the roll-like form of the gas jetting device in the illustrated embodiment is not exclusive, and the invention can employ gas jetting devices having different constructions. For instance, the gas jetting device can have the form of a semi-circular cylinder or an oval cylinder or, as shown in FIG. 6, even a form in which only the portion of the outer surface defining the non-contact carrying region is curved while the other portion is rectilinear. The sole problem involved by the configuration of the gas jetting device is the radius of curvature of the outer surface of the device defining the non-contact carrying region. Although the support does not make direct contact with the gas jetting device, the radius of curvature of the support is substantially same as that of the outer surface of the gas jetting device because only a small gap exists therebetween. Since the tension in the support is constant over the entire part thereof, the back pressure in the non-contact carrying region is determined by the radius of curvature of the surface of the gas jetting device.

As stated before, the fluctuation of the lift will be increased when the back pressure is too small. To the contrary, a too large back pressure will make it difficult to obtain a balance with the static carrying pressure. This means that there must be a certain range of preferred back pressure and, hence, a certain range of radius of curvature of the outer surface of gas jetting device corresponding to the practical range of the tension in the support. This problem is serious particularly in the region adjacent to the end of the coater by which the liquid is applied to the support, where the fluctuation of lift of the support has to be minimized. A study conducted by the present inventors proved that the preferred range of radius of curvature is 30 to 200 mm, although not exclusive. Namely, the invention can of course be carried out with values of radius of curvature falling out of the range specified above.

The application of the liquid to one and the other sides of the support can be conducted by known methods such as bead application method, extrusion application method and liquid film method.

Figure 5:
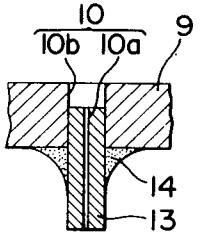
FIG. 5 is a sectional view of a gas jetting nozzle port, illustrating the process for manufacturing the gas jetting device.

An example of the methods for fabricating the gas jetting device incorporated in the coating apparatus of the invention will be described hereinunder. The throat portion of each fluid jetting nozzle port in the gas jetting device has an extremely small diameter and a considerable length. It is quite difficult to form such a nozzle port by a mechanical processing. Namely, the smaller the diameter of the bore is, the more difficult the drilling becomes. The drilling is materially impossible when the depth of the bore gets large. Therefore, the gas jetting device is fabricated by, for example, a process as shown in FIG. 5. According to this process, nozzle ports 10 having an inside diameter equal to the diameter of the enlarged outlet portion 10*b* are formed in the wall of the hollow casing. Then, pierce tubes 13 having a small through bore of a diameter equal to the diameter of the throat portion 10*a* is fitted in and fixed to the wall of each nozzle port 10, to complete the gas jetting device. The diameter of the enlarged outlet portion 10*b* is large enough to permit the formation by drilling. It is even possible to select the diameter of the enlarged outlet portion 10*b* at such a value as to permit an easy formation by drilling. On the other hand, the pierce tube 13, which has an outside diameter equal to the inside diameter of the enlarged outlet portion 10*b* and provided with a small through hole of a diameter equal to that of the throat portion 10*a*, can be formed by using, for example, ceramics as the material.

Another advantage brought about by this process is that the length of the enlarged outlet portion 10*b* and the length of the throat portion 10*a* can be determined simultaneously. Namely, since the length of the pierce tube made of a ceramics can be selected freely while the fixing of the tube can be made easily by an adhesive 14 of, for example, epoxy group, it is also possible to select the length of the enlarged outlet portion 10*b* freely. In addition, undesirable leak of the gas through the gap around the pierce tube 13 can be avoided by fixing the pierce tube 13 by the adhesive 14 applied to the outer peripheral surface of the latter as shown in the drawings.

The invention will be more fully understood from the following description of Examples.

EXAMPLE 1

A coating apparatus as shown in FIG. 1 was constructed to have a gas jetting device 3' in the form of a hollow roll which is provided in its wall with a plurality of gas jetting nozzle ports 10 each having two portions of different diameters as shown in FIG. 3. The radius of the outer surface of the roll was selected to be 100 mm. Each gas jetting nozzle port 10 had a throat portion 10*a* and an enlarged outlet portion 10*b* both having circular cross-sections. The diameter $d_1$ and the length $l_1$ of the throat portion were selected to be 0.08 mm and 10 mm, respectively, while the diameter $d_2$ and length $l_2$ of the enlarged outlet portion 10*b* were determined to be 1.5 mm and 3 mm, respectively. The ratio of port area was 0.02%. Clean air filtrated by a filter of 2 microns mesh was supplied into the hollow 12 of the gas jetting device 3' at a gauge pressure of 1 $Kg/cm^2$ and was jetted from the gas jetting nozzle ports 10. The support 2 used was a film of polyethylene terephthalate of 0.18 mm thick having a width of 400 mm, which was fed at a speed of 20 m per minute under a tension of 0.1 Kg/cm width. Then, emulsion of silver halide sensitive to Röntgen ray, together with gelatine as a binder, was applied by means of a coater (slide hopper) 1 to form an underlying layer onto which further applied was an aqueous solution of gelatine as a protective layer. The thicknesses of the underlying layer and the protective layer immediately after the application were 55 microns and 20 microns, respectively. Then, in the cold air zone 8, cold air chilled to about 5° C. was applied through the slitted plate 7 to the coating layer 4 to gelate the latter. After the gelation of the layer 4, double-layer coating was effected on the other side of the support by a coater (slide hopper) 1' operating under the same condition as the coater 1, while the support is carried in the non-contact manner in the non-contact carrying regon. The support was then forwarded to the drying after gelation of the coating layer 11. The coating layer 11 thus formed had a uniform thickness and was entirely free from coating defect such as unevenness of thickness in the form of transverse step lines. The coating layer 4 also was finished in a good manner without suffering from disorder of the coating layer surface due to contact with the surface 9 of the gas jetting device and unevenness of thickness due to blowing.

EXANPLE 2

Coating on both sides of a support was conducted under the same condition as Example 1, although the feeding speed was increased to 100 m per minute. Coating layers having uniform thicknesses and suffering no coating defect were formed on both sides of the support as in the case of Example 1.

EXAMPLE 3

A coating apparatus was constructed in which the contact type supporting roll 3 was substituted by a gas jetting device having the same construction as the device 3' so that the support was carried in a non-contacting manner also in the region where the application is made by the coater 1. Coating was effected on both sides of the support with this coating apparatus. After the drying, coating layers of uniform thicknesses and having no coating defect were formed.

EXAMPLE 4

A coating apparatus as illustrated in FIG. 1 was used. The roll type gas jetting device 3' had a plurality of gas jetting nozzle ports 10 each having a throat portion 10*a* and an enlarged outlet portion 10*b*. The diameter $d_1$ and the length $l_1$ of the throat portion were 0.2 mm and 15 mm, respectively, while the diameter $d_2$ and length $l_2$ of the enlarged outlet portion 10*b* were 3 mm and 5 mm, respectively. The ratio of port area was selected to be 0.1%. Clean air filtrated by an air filter of 2 microns mesh was supplied into the hollow 12 of the gas jetting device at a gauge pressure of 0.2 $Kg/cm^2$ and was jetted from the gas jetting nozzle ports 10. A polyethylene terephthalate film of 0.1 mm thick having a width of 400 mm was used as the support. The support 2 was fed at a speed of 40 m per minute under a tension of 0.1 Kg/cm width. Then, a coating was conducted on one side of the support 2 by the coater 1 to form an underlying layer of aqueous solution of gelatine dissolving an antihalation color element for photography and a protective layer of aqueous solution of gelatine. The thicknesses of the underlying layer and the protective layer were 50 microns annd 20 microns, respectively, in the state immediately after the application. Then, the coating layer 4 consisting of two layers was cooled and gelated by cold air of about 5° C. applied through the slitted plate 7 in the cold air zone 8. Then, while carrying the support in a non-contacting manner, a coating was effected on the other side of the support 2 under the same condition as above to form an underlying layer of emulsion of silver halide as a photosensitive material for printing togther with gelatine as a binder and an overlying layer of aqueous solution of gelatine as the protective layer. These layers formed on the other side of the support had thicknesses of 60 microns and 20 microns in the state immediately after the drying. After the gelation of the coating layer 11 constituted by these two layers, the support was subjected to a drying step. The coating layer 11 had uniform thickness and exhibited no unevenness of thickness in thwe form of transverse step lines. The coating layer 4 also was finished in good order without suffering from any damage due to contact with the outer surface 9 of the gas jetting device and unevenness of thickness due to blowing.

The determination of the optimum ratio of port area to some extent relies upon experiments. To this end, it is suggested to fabricate a gas jetting device as disclosed hereinbefore and to determine the optimum ratio of port area by decreasing the same gradually until a lift of the support is uniformalized in the widthwise direction of the support.

As to the relationship between the width of the support and the rate of jetting of the gas, it is advisable that the condition of $W^2 \cdot Q \leqq 5 \times 10^5$ is met, where W represents the width (cm) of the support, while Q represents the gas jetting rate per unit area (N ml/min $cm^2$).

Figure 9:
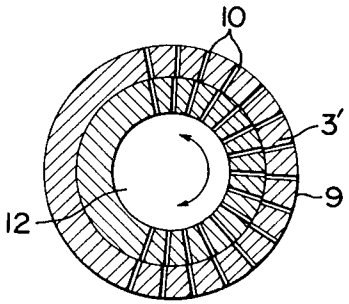
FIG. 9 is a sectional view of a further example of the gas jetting device incorporated in the coating apparatus of the invention.

When the same gas jetting device is to be used for supports of different widths, it is preferred to employ a construction which permits an easy change of the ratio of port area to the area of the outer surface of the gas jetting device. For instance, it is possible to use an arrangement shown in FIG. 9 in which two or more gas jetting devices each having the gas jetting nozzle ports are lapped for sliding motion relatively to each other. In use, these gas jetting devices are slidably rotated to meet the width (i.e. the area, which is a function of width) of the support to be coated as indicated by an arrow in this Figure to adjust the degree of lap of the gas jetting nozzle ports, thereby to vary the minimum cross-sectional area in each passage of the gas.

Figure 7:
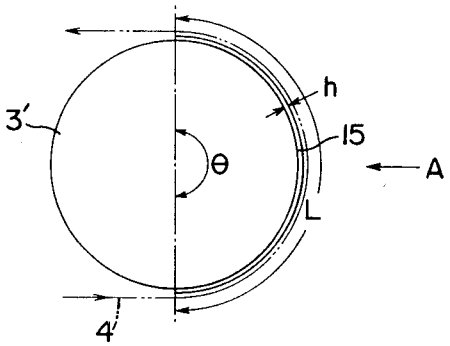
FIG 7 is a side elevational view of still another example of the gas jetting device incorporated in the coating apparatus of the invention.
Figure 8:
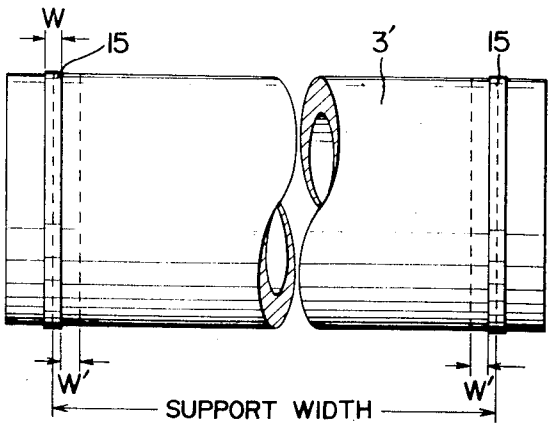
FIG. 8 is a front elevational view of the gas jetting device as viewed in the direction of the arrow A of FIG. 7.

According to one preferred form of the invention, the gas jetting device is provided at its widthwise end portions with annular peripheral ridges 15 so as to oppose to both marginal edges of the support 2 but not to contact the latter, as will be seen from FIGS. 7 and 8. According to this arrangement, it is possible to impose a resistance on the flow of gas which tends to escape laterally from both marginal edges of the support. It is also possible to provide, in order to prevent any decrease of the lift of support at both widthwise end portions of the latter, means for increasing the rate of jetting of air only at regions opposing to both widthwise end portions of the support. This can be achieved by arranging such that the ratio of port area is greater at both axial end portions of the gas jetting device than that in the central region of the same.

EXAMPLE 5

A coating apparatus having the construction as illustrated in FIG. 1 was used for effecting coating on a support having a width of 1,000 mm. A hollow roll type gas jetting device 3' having a plurality of gas jetting nozzle ports 10 as shown in FIG. 3 was employed. The radius of the roll surface was selected to be 100 mm. Each gas jetting nozzle port had a throat portion and an enlarged outlet portion both having circular cross-sections. The diameter $d_1$ and the length $l_1$ of the throat portion were selected to be 0.05 mm and 10 mm, respectively, while the diameter $d_2$ and length $l_2$ of the enlarged outlet portion were determined to be 1.5 mm and 3 mm, respectively. The ratio of port area was selected to be 0.002%. In the boundary 13 of the non-contact type support, extending over 10 mm along the length of the support, the diameter d and the length l were selected to be 180 microns and 10 mm, respectively, and the ratio of port opening was determined to be 0.157%, over the entire width of the support.

Air was supplied to the hollow of the roll type gas jetting device at a gauge pressure of 1.0 $Kg/cm^2$ and was jetted through the gas jetting nozzle ports 10. The mean value of the gas jetting rate per unit area of the non-contact carrying region was 6.33 Nml/min.$cm^2$. Thus, the value $W^2 \cdot Q$ is calculated to be $6.33 \times 10^4$.

As shown in FIG. 7, the length L of the non-contact type carrying region is substantially equal to $R \cdot \theta$, were $\theta$ represents the angle over which the support is affected by the roll type gas jetting device. This angle will be referred to as "lap angle", hereinunder. In the illustrated embodiment, the angle $\theta$ is 180° so that the length L is about 157 mm. Since the support 2 is carried in a non-contacting manner, the gas jetting device 3' is not rotated. It is, of course, possible to rotate the gas jetting device having gas jetting nozzle ports over the entire periphery thereof, but such an arrangement is not essential. A solution as the material of photosensitive photographic layer was applied by a coater 1 such as a slide hopper to one side of the support 2 while the latter was carried by an ordinary direct contact type back-up roll 3 to form a coating layer 4 which was gelated as the support 2 passed through the cold air zone 8. Then, while the support 2 was supported in a non-contacting manner by the gas jetting device 3', a solution as the photosensitive material was applied by a coater 1' such as a slide hopper onto the opposite side of the support 2 to the coating layer 4 to become a coating layer 11. In this case, a solution for Röntgen photography was used. More specifically, the coating by each coater 1, 1' was conducted to form a double layer consisting of an underlying layer of emulsion of silver halide sensitive to Röntgen ray together with gelatine as a binder, and an overlying protective layer consisting of aqueous solution of gelatine, such that the underlying and overlying layers have thicknesses of 55 microns and 20 microns, respectively, in the wet state. The support 2 was a polyethylene terephthalate film of 180 microns and was fed at a speed of 50 m per minute under the tension of 0.1 Kg/cm width. The lift of the support 2, i.e. the distance between the outer surface of the gas jetting device and the coating layer 4, was 200 microns at the central portion opposing to the end of the coater 1' and 170 microns at both widthwise end portions. The values of lift in other portions all fall within the region between 200 microns and 170 microns. After the coating on both sides of the support, the support was made to pass through a non-contact type setting zone (not shown) and a non-contact type drying zone (not shown). The coating layers on both sides of the support after the drying exhibited high uniformity without suffering from any coating defect such as unevenness of thickness in the form of longitudinal stripes, and the photographic film thus produced showed a superior photographic performance.

Another experiment was conducted under the same condition as Example 5 except that the number of the gas jetting ports were increased to increase the ratio of port opening to 0.02%. The amount of lift in this case was 380 microns at the central portion of the support opposing to the coater 1' and 200 microns at both widthwise end portions. The value $W^2 \cdot Q$ therefore was calculated to be $6.33 \times 10^5$. It was found that, even though the coater gap is optimumly adjusted at the central portion of the support, the coater gaps at both widthwise end portions undesirably get greater and the solution cannot be applied by the coater 1' to both widthwise end portions of the support. Namely, it was not possible to effect uniform coating.

EXAMPLE 6

Coating was effected on both sides of a support under the same condition as Example 5 excepting that the support was fed at an elevated speed of 120 m per minute. After a drying, uniform coating layers having no unevenness such as longitudinal stripes was obtained on both sides of the support 2 as in the case of the embodiment 5.

EXAMPLE 7

The path of the support upstream from the gas jetting device 3' was changed to allow the lap angle of the gas jetting device 3' to be increased to 250°. The number of the gas jetting ports was increased corresponding to the increment of the lap angle. Other conditions were materially indentical to those of Example 5. The amounts of lift were 230 microns at the central portion and 200 microns at both widthwise end portions of the support. The amounts of lift at other portions of the support all falled within this region. As a result of coating operation with this arrangement under the same condition as Example 5, uniform coating layers were formed on both sides of the support without suffering from any coating defect.

EXAMPLE 8

Coating was conducted under the same condition as Example 5, excepting that the radius R was changed to 50 mm. The amounts of lift were 170 microns at the central portion and 150 microns at both widthwise end portions of the support, respectively. Uniform coating layers having no defect were formed as in the case of Example 5.

EXAMPLE 9

Coating was conducted on both sides of the support under the same condition as Example 8 except that the support feed speed was increased to 120 m per minute. After a drying, a uniform coating layers having no defect such as longitudinal stripes were obtained on both sides of the support as in the case of Example 8.

EXAMPLE 10

Coating was conducted under the same condition as Example 7 except that the radius R was changed to 50 mm. The amounts of lift were 200 microns at the central portion and 180 microns at both widthwise end portions of the support. Uniform coating layers having no defect was obtained as in the case of Example 7.

EXAMPLE 11

The coating apparatus as shown in FIG. 1 was used to effect coating on both sides of a polyethylene terephthalate film of 100 microns thick and 2000 mm wide with a solution of photosensitive material for printing. A roll type gas jetting device having a radius R of 100 mm was used. As shown in FIGS. 7 and 8, annular peripheral ridges 15 having a height h of 300 microns, width w of 10 mm and a length L of 300 mm were formed on the outer surface of the roll type gas jetting device so as to oppose to both marginal ends of the support. As in the case of Example 5, the gas jetting portions were constituted by circular gas jetting ports having a diameter d of 50 microns and length l of 10 mm. In this case, however, the number of the gas jetting ports was decreased to reduce the ratio of port area down to 0.0008%. The gas was supplied at a pressure of 1.0 $Kg/cm^2$ to obtain a gas jetting rate Q of 2.5 N $ml/min\ cm^2$. In this case, the value $W^2 \cdot Q$ was calculated to be $10^5$. While feeding the support at a speed of 60 m per minute, two layers were formed on first side of the support by the coater 1: namely, an underlying layer of aqueous solution of gelatine dissolving a color element and an overlying protective layer of aqueous solution of gelatine at thicknesses of 55 microns and 20 microns, respectively, in the wet state. Then, a coating was effected by the coater 1' on the other side of the support to form an underlying layer of emulsion of silver halide as a photosensitive material for printing and an overlying protective layer of aqueous solution of gelatine at thicknesses of 55 microns and 20 microns, respectively, in the wet state. The support was then subjected to a non-contact type carrying and non-contact type drying. The amounts of lift of the support was maximum (400 microns) at the central portion opposing to the end of the coater 1' and minimum (370 microns) at both widthwise end portions of the support. As a result, uniform coating layers having no coating defect were formed on both sides of the support. The photosensitive film thus produced exhibited superior photographic performance.

EXAMPLE 12

Coating was conducted under the same condition as Example 10 excepting that the diameter of the gas jetting nozzle ports was increased to 180 microns to realize a greater ratio of port area of 0.05%, in both widthwise end regions of a width w' of 10 mm (see FIG. 8). In consequence, the lift was maintained within 10 microns over the whole width of the portion of the support opposing to the end of the coater 1'. With this arrangement, uniform coating layers having no unevenness such as longitudinal stripes were formed by a coating operation conducted under the same condition as Example 11, even at an elevated support feed speed of 120 mm per minute.

CONTROL EXAMPLE 1

Coating on both sides of a support was conducted under the same condition as Example 1, although the diameter $d_1$ and $d_2$ were changed to be 1 mm and 5 mm, respectively.

The fluctuation of the lift of some 10 microns was observed and the coating layer exhibited unevenness of thickness in the form of transverse step lines.

CONTROL EXAMPLE 2

Coating on both sides of a support was conducted under the same condition as Example 1, although the diameter $d_1$ and $d_2$ were changed to be 0.5 mm and 8 mm, respectively.

The fluctuation of the lift of some 10 microns was observed and the coating layer exhibited unevenness of thickness in the form of transverse step lines.

Although the invention has been described through specific terms, it is to be noted that the described embodiments are not exclusive and various changes and modifications may be imparted thereto without departing from the scope of the invention which is limited solely by the appended claims.

What is claimed is:

1. A coating apparatus having a coater and a gas jetting device disposed to oppose to each other across a continuously running support, so that the coating is made by said coater while said support is carried in a non-contacting manner by a gas jetted from said gas jetting device towards said support, characterized in that said gas jetting device has a hollow housing into which the gas is introduced from a gas source at a pressure of between 0.1 and 5 $Kg/cm^2$, a portion of the wall of said housing adjacent to said support being curved and defining a non-contact carrying region of high static pressure and provided with a plurality of spaced-apart gas jetting nozzle ports through which said gas is jetted towards said support, each gas jetting nozzle port having a throat portion of predetermined length and presenting a minimum cross-sectional area inwardly spaced from the outer surface of said wall of said housing and an enlarged outlet portion of a length less than said predetermined length and presenting a comparatively large cross-section area opening in said surface of said wall, said minimum cross-sectional area being equivalent to that of a circular area having a diameter ranging between 0.02 and 0.5 mm and said maximum cross-sectional area being equivalent to that of a circular area having a diameter ranging between 0.5 and 5 mm.

2. A coating apparatus according to claim 1, further comprising means for adjusting the ratio of the total area of the throat portion of the ports in the plane perpendicular to the gas jetting direction to the whole area of the outer surface of said gas jetting device in such a manner that the rate of jetting of the gas from a unit area of the non-contact carrying region of the outer surface of said gas jetting device becomes smaller as the width of said support is increased.

3. A coating apparatus according to claim 1 wherein each gas jetting nozzle port comprises a tubular member mounted in a bore of a diameter equal to that of said enlarged outlet portion in said wall of said housing, said tubular member having an outer configuration for substantially closing said bore and provided with a small through hole of a diameter equal to the diameter of the said throat portion in said wall of said housing.

4. A coating apparatus according to claim 1, wherein the predetermined length of the throat portion and the length of the enlarged outlet portion range between 5 and 30 mm and between 1 to 5 mm, respectively.

5. A coating apparatus according to claim 1 or 2, including means for cleaning the gas supplied to the gas jetting device from said gas source.

* * * * *